US008973519B2

(12) United States Patent
Bindics et al.

(10) Patent No.: US 8,973,519 B2
(45) Date of Patent: Mar. 10, 2015

(54) RECLOSER POSITION INDICATOR

(75) Inventors: Charles Bindics, Northampton, PA (US); William Ayala, III, Hackettstown, NJ (US); Geoffrey Reed, East Stroudsburg, PA (US)

(73) Assignee: Thomas & Betts International, Inc., Wilmington, DE (US)

( * ) Notice: Subject to any disclaimer, the term of this patent is extended or adjusted under 35 U.S.C. 154(b) by 338 days.

(21) Appl. No.: 13/545,322

(22) Filed: Jul. 10, 2012

(65) Prior Publication Data

US 2013/0036965 A1 Feb. 14, 2013

Related U.S. Application Data

(60) Provisional application No. 61/522,737, filed on Aug. 12, 2011.

(51) Int. Cl.

| | |
|---|---|
| ***H01H 9/16*** | (2006.01) |
| ***H01H 33/66*** | (2006.01) |
| *H01H 33/38* | (2006.01) |
| *H01H 33/666* | (2006.01) |

(52) U.S. Cl.

CPC ..... *H01H 9/16* (2013.01); *H01H 9/161* (2013.01); *H01H 33/38* (2013.01); *H01H 33/666* (2013.01)

USPC ..... 116/285; 116/286; 335/17

(58) Field of Classification Search

CPC ..... H01H 9/16; H01H 9/161; H01H 33/38; H01H 33/666; H01H 71/04; H01H 2009/0292

USPC ..... 116/277, 284, 285, 286, 298, 299; 200/308; 355/17, 26, 27, 28; 361/114, 361/115

See application file for complete search history.

(56) References Cited

U.S. PATENT DOCUMENTS

| | | | | |
|---|---|---|---|---|
| 2,866,965 A | | 12/1958 | Houdek, Jr. et al. | |
| 3,225,170 A | | 12/1965 | Chabala et al. | |
| 3,721,789 A | * | 3/1973 | Black | 200/308 |
| 3,727,019 A | * | 4/1973 | Harvey | 218/140 |
| 3,852,556 A | | 12/1974 | Kane et al. | |

(Continued)

FOREIGN PATENT DOCUMENTS

| | | |
|---|---|---|
| CN | 201282045 Y | 7/2009 |
| WO | 98/45163 | 10/1998 |

OTHER PUBLICATIONS

Thomas & Betts, Inc. "Recloser Construction" Three-Phase Vacuum Recloser, p. 13.

*Primary Examiner* — R. A. Smith

(74) *Attorney, Agent, or Firm* — Snyder, Clark, Lesch & Chung, LLP

(57) ABSTRACT

A status indicator includes a display disc with a pin located within a central portion if the display disc, a first colored section, and a second colored section. The status indicator also includes a lens unit with an opaque section and a non-opaque section to alternately reveal the first colored section or the second colored section such that either the first or the second colored section is visible from any angle within a hemisphere below the status indicator. The status indicator also includes an indicator cam configured to receive a linear force initiated by an actuator component and to translate the linear force to a rotational force on the pin. The rotational force causes the display disc to rotate from a first position to a second position that aligns the second colored section with the non-opaque section.

22 Claims, 8 Drawing Sheets

(56) References Cited

U.S. PATENT DOCUMENTS

| | | | | | |
|---|---|---|---|---|---|
| 4,132,986 | A | | 1/1979 | Hart et al. | |
| 4,186,365 | A | | 1/1980 | Fahnoe | |
| 4,494,566 | A | * | 1/1985 | Sinclair et al. | 137/556 |
| 4,535,409 | A | | 8/1985 | Jindrick et al. | |
| 5,079,530 | A | | 1/1992 | Tsuchiyama | |
| 5,103,364 | A | | 4/1992 | Kamp | |
| 5,223,822 | A | * | 6/1993 | Stommes et al. | 137/551 |
| 5,278,530 | A | * | 1/1994 | Zovath | 335/17 |
| 5,287,087 | A | | 2/1994 | Jencks et al. | |
| 5,343,192 | A | | 8/1994 | Yenisey | |
| 5,353,014 | A | | 10/1994 | Carroll et al. | |
| 5,497,096 | A | | 3/1996 | Banting | |
| 5,535,698 | A | * | 7/1996 | Trevisan | 116/277 |
| 5,663,712 | A | | 9/1997 | Kamp | |
| 5,721,659 | A | | 2/1998 | Young | |
| 5,734,207 | A | | 3/1998 | LeCourt | |
| 5,912,604 | A | * | 6/1999 | Harvey et al. | 335/9 |
| 5,936,495 | A | | 8/1999 | LeCourt | |
| 6,044,791 | A | * | 4/2000 | LaMarca et al. | 116/277 |
| 6,198,062 | B1 | | 3/2001 | Mather et al. | |
| 6,542,056 | B2 | | 4/2003 | Nerstrom et al. | |
| 6,559,394 | B2 | * | 5/2003 | Yang | 200/50.26 |
| 7,135,945 | B2 | | 11/2006 | Whipple et al. | |
| 7,182,647 | B2 | | 2/2007 | Muench et al. | |
| 7,569,785 | B2 | | 8/2009 | Mills et al. | |
| 7,579,571 | B2 | * | 8/2009 | Siebens et al. | 218/120 |
| 7,683,745 | B2 | | 3/2010 | Gouhl et al. | |
| 7,819,133 | B2 | * | 10/2010 | Minervini et al. | 137/556 |
| 7,864,005 | B2 | | 1/2011 | Gouhl et al. | |
| 8,375,883 | B2 | * | 2/2013 | Soldo | 116/277 |
| 2006/0219154 | A1 | * | 10/2006 | Moninski | 116/281 |
| 2013/0008369 | A1 | * | 1/2013 | Binkley | 116/305 |

* cited by examiner

520

RECLOSER POSITION INDICATOR

CROSS-REFERENCE TO RELATED APPLICATION

This application claims priority under 35. U.S.C. §119, based on U.S. Provisional Patent Application No. 61/522,737, filed Aug. 12, 2011, the disclosure of which is hereby incorporated by reference herein.

BACKGROUND INFORMATION

A recloser may generally be viewed as a circuit breaker equipped with a mechanism that can automatically close the circuit breaker after the breaker has been opened due to a fault. Reclosers may be used, for example, on overhead power distribution systems. Since many short circuits on overhead lines clear themselves, a recloser can improve service continuity by automatically restoring power to a line after a momentary fault.

DETAILED DESCRIPTION OF PREFERRED EMBODIMENTS

The following detailed description refers to the accompanying drawings. The same reference numbers in different drawings may identify the same or similar elements. Also, the following detailed description does not limit the invention.

Embodiments described herein provide a position indicator for a recloser that includes rotational movement and/or a lighted color indication. For example, in one embodiment, the position indicator may include a display disc with multiple first-colored (e.g., green) sections and multiple second-colored (e.g., red) sections that indicate a status of the recloser. A lens unit, affixed to a portion of the recloser, may physically support the display disc and may allow the display disc to rotate within the lens unit. The lens unit may include multiple opaque sections and multiple non-opaque sections with which the display disc may be aligned to alternately reveal only the first-colored sections or only the second-colored sections. When the recloser changes position (e.g., trips a breaker), an indicator care may receive a linear force initiated by a component within the recloser. The indicator cam may translate the linear force to a rotational force on the display disc to cause the display disc to rotate from a first position (e.g., that aligns the multiple first-colored sections with the multiple non-opaque sections) to a second position (e.g., that aligns the multiple second-colored sections with the multiple non-opaque sections). The status indicator may also include a lighting unit configured to illuminate the multiple non-opaque sections from within the status indicator, such that either the multiple first-colored sections or the multiple second-colored sections can be visible from any angle within a viewing hemisphere below the status indicator.

Figure 1:
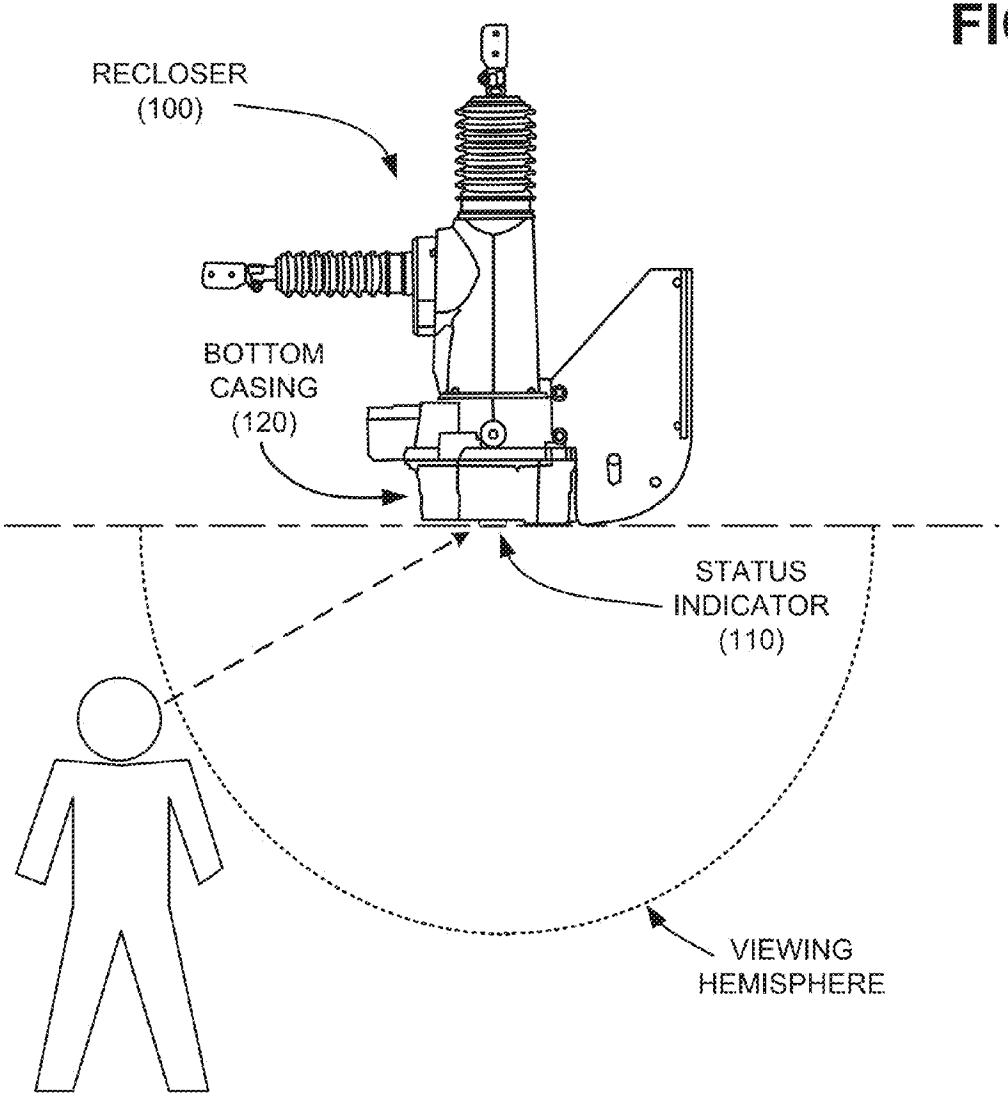
FIG. 1 provides a side view of a recloser with a position indicator according to an implementation described herein.

FIG. 1 provides a side view of a recloser 100 with a status indicator 110 according to an implementation described herein. Referring to FIG. 1, recloser 100 may include a status indicator 110 and a bottom casing 120. As shown in FIG. 1, bottom casing 120 may include an opening to allow status indicator 110 to be exposed through bottom casing 120 so as to be visible to a person (e.g., a technician) standing below recloser 100. As described further herein, a multi-colored display disc within status indicator 110 may rotate on a fixed axis to provide a visible status indication from any angle within a viewing hemisphere below bottom casing 120. Additionally, or alternatively, status indicator 110 may include a lighting unit to provide a color-coded status indication at night. In one implementation, status indicator 110 may be included within an actuator of recloser 100.

Figure 2:
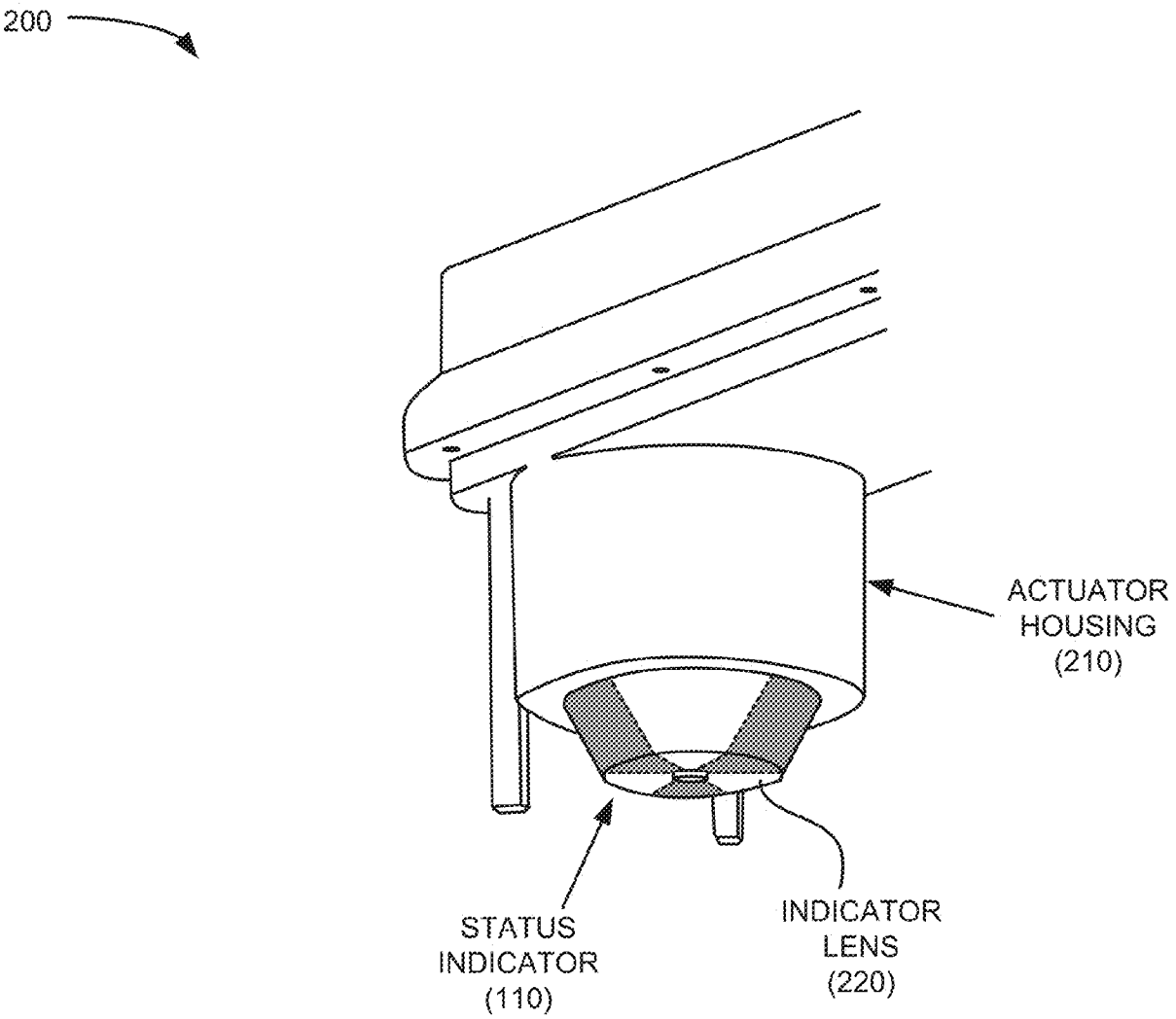
FIG. 2 is an isometric view of an actuator for a recloser consistent with an exemplary embodiment.

FIG. 2 provides an isometric view of an actuator 200 for recloser 100 consistent with an exemplary embodiment. Status indicator 110 may be integrated with an actuator housing 210 and/or operatively connected to actuator 200. For example, actuator 200 may be contained within bottom casing 120 (not shown in FIG. 2) of recloser 100 and positioned such that an indicator lens 220 of status indicator 110 may protrude through a hole in bottom casing 120 to provide for visibility to a person below recloser 100.

Housing 210 may be an enclosed structure that houses components of actuator 200 and may provide a structure to support components of status indicator 110, including indicator lens 220. Housing 210 may be metal, plastic, or a composite material. Indicator lens 220 may provide a viewing area to display indications by status indicator 110. Indicator lens 220 is described further in connection with, for example, FIG. 3.

Figure 3:
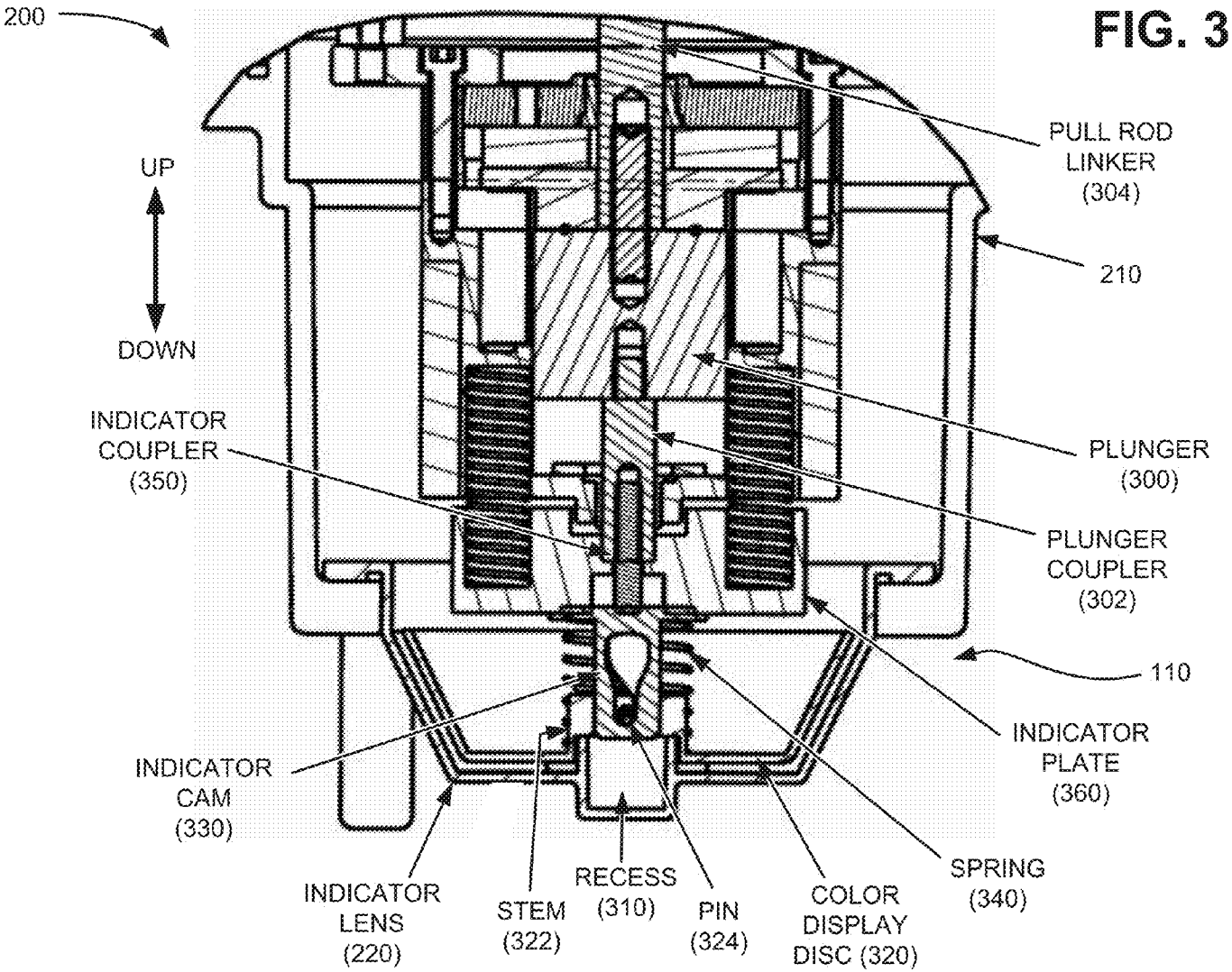
FIG. 3 is a cross-sectional view of the actuator of FIG. 2 according to an implementation described herein.

FIG. 3 provides a cross-sectional view of a portion of actuator 200 in accordance with an exemplary embodiment. Referring to FIG. 3, actuator 200 may include status indicator 110, housing 210, and a plunger 300. Status indicator 110 may include indicator lens 220 with a recess 310, a color display disc 320, an indicator cam 330, a spring 340, an indicator coupler 350, and an indicator plate 360. The exemplary configuration illustrated in FIG. 3 is provided for simplicity. It should be understood that actuator 200 may include more or fewer devices than illustrated in FIG. 3.

Plunger 300 may be located in a central portion of actuator 200. Plunger may move axially (e.g., linearly in an up or down direction indicated in FIG. 3) within a bore of actuator 200 in response to, for example, application/removal of a magnetic field. Plunger 300 may be linked to plunger coupler 302 and pull rod linker 304. The axial motion of plunger 300 may be used to perform an operation (e.g., open/close a circuit breaker) and provide a status (e.g., a position indication) of the operation. Status indicator 110 generally may be configured to respond to changes in position of plunger 300. Components of status indicator 110 may be directly or indirectly connected to plunger 300 to provide status indications based on the position of plunger 300.

Indicator lens 220 may include a surface to physically support and selectively display portions of color display disc 320. Indicator lens 220 may include a transparent material, such as glass, plastic (e.g., polycarbonate), crystal, etc. As shown in FIGS. 2 and 3, indicator lens 220 may include a partially-conical surface to provide visibility of color display disc 320 from multiple viewing angles. Indicator lens 220 may be secured to actuator housing 210 using mechanical fasteners, compression fit, tongue-in-grove mechanisms, etc. In one implementation indicator lens 220 may include a seal against actuator housing 210 to provide a weatherproof enclosure (e.g., to protect other components of actuator 200/status indicator 110) from moisture, dust, etc.). In one implementation (e.g., as shown in FIG. 2), indicator lens 220 may include alternating radial sixty degree opaque and non-opaque (e.g., transparent/translucent) sections. The opaque sections may be formed, for example, using separate films, coatings, or other materials applied to indicator lens 220. In another implementation, the opaque sections may be included as a separate layer/disc between indicator lens 220 and color display disc 320. Lens 220 and the separate layer of opaque sections may be collective referred to as "indicator lens 220" or a lens unit. As described further below, indicator lens 220 may also include recess 310 to create a channel for axial motion (e.g., in an up or down direction indicated in FIG. 3) of indicator cam 330.

Figure 4:
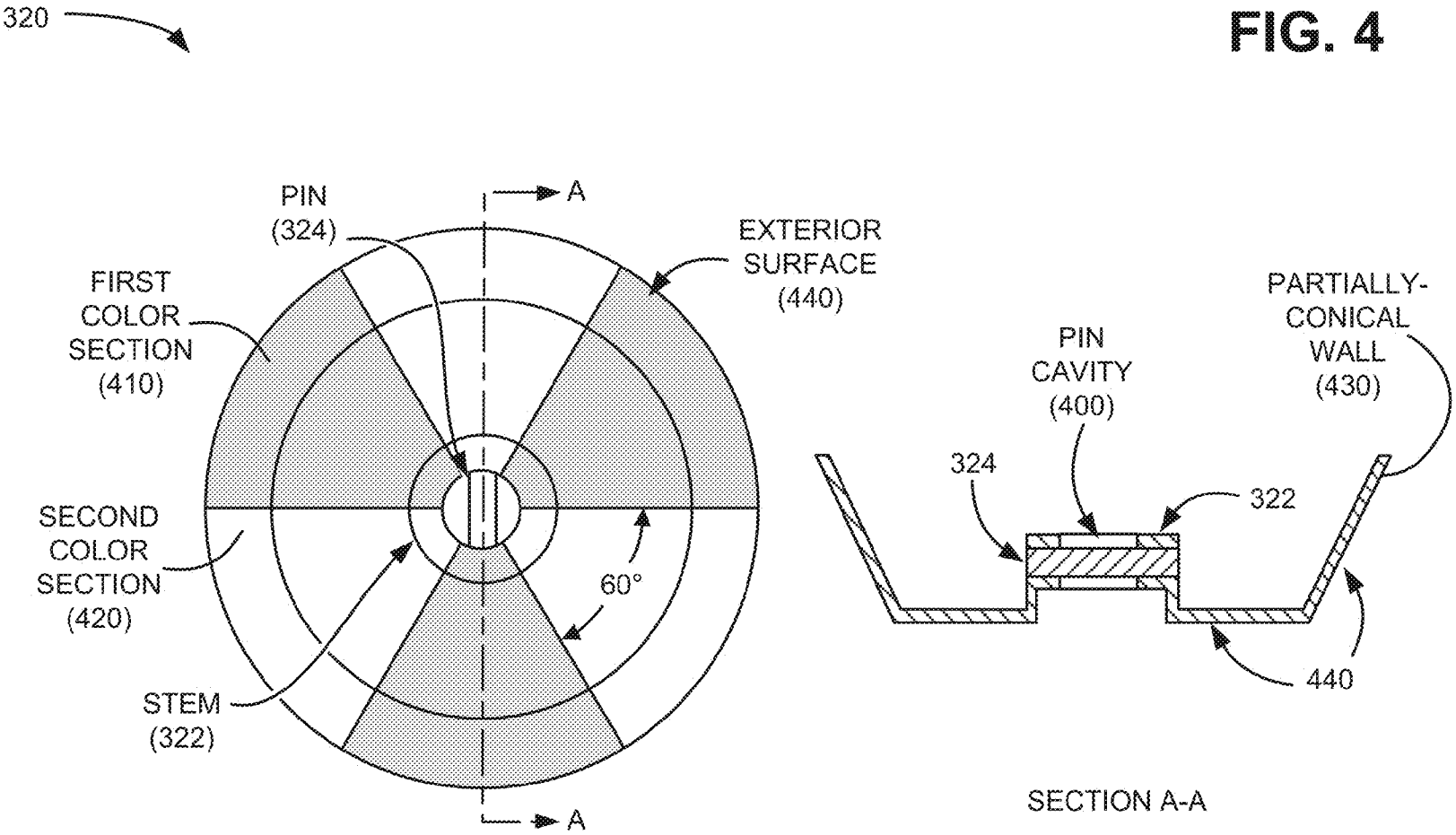
FIG. 4 provides a bottom and a cross-sectional view of the color display disc of FIG. 3.

FIG. 4 provides a bottom and a cross-sectional view of color display disc 320. Referring collectively to FIGS. 3 and 4, color display disc 320 may include a stem 322, a pin 324, a pin cavity 400, and color-coded sections 410/420 to visibly indicate a status of recloser 100. Color display disc 320 may be configured with a partially conical wall 430 (e.g., of the same angle as on indicator lens 220) to generally conform to interior surfaces of indicator lens 220. In an exemplary implementation, color display disc 320 may include alternating sections 410 and 420 of a first color (e.g., green) and a second color (e.g., red) along an exterior surface 440 and that each cover about sixty radial degrees of the circular bottom and conical sides of status indicator 110. In other implementations, color display disc 320 may include words (e.g., "open," "closed," etc.) addition to, or in place of, colors for color-coded sections 410/420.

Color display disc 320 and indicator lens 220 may be aligned so that indicator lens 220 may selectively expose only sections 410 or 420 of one color of color display disc 320 at any time. That is, with a sixty degree rotation of color display disc 320 within indicator lens 220, status indicator 110 may switch between only first color sections 410 being visible (e.g., through non-opaque sections of indicator lens 220, while the second color sections 420 are blocked by the opaque sections of indicator lens 220) and only the second color sections 420 being visible.

Stem 322 of color display disc 320 may support pin 324. In one implementation, pin 324 may be made of a different piece and/or material than color display disc 320 and may be inserted through stem 322 and indicator cam 330. In another implementation, pin 324 may be molded with color display disc 320 as a single piece. Pin 324 may extend through pin cavity 400 and indicator cam 330. Pin 324 may be configured to fit within indicator cam 330 such that axial movement (e.g., in an up or down direction indicated in FIG. 3) of indicator cam 330 may impart rotational motion to pin 324 and color display disc 320.

Referring again to FIG. 3, indicator cam 330 may be connected to indicator coupler 350 and may move axially within recess 310 and pin cavity 400. Indicator cam 330 may be metal, plastic, or a composite material. Motion of plunger 300 may be translated via plunger coupler 302 and indicator coupler 350 to apply a linear force on indicator cam 330. Indicator cam 330 may include a substantially spiral channel to engage pin 324. Linear force applied to indicator cam 330 may cause pin 324 to rotate about a common axis of indicator lens 220/color display disc 320/indicator cam 330. The axial travel of indicator cam 330 may correspond to the travel distance (or stroke distance) of plunger 300. In an exemplary implementation, a maximum distance of axial travel of indicator cam 330 may correspond to a 60 degree rotation of color display disc 320. For example, an axial travel distance of 0.004 inches by indicator cam 330 may correspond to a 60 degree rotation of color display disc 320.

Spring 340 may include a coil spring or another type of spring. Spring 340 may provide downward force on stem 322 to maintain color display disc 320 in position against indicator lens 220, while still permitting rotation of color display disc 320, regardless of the position of indicator plate 360.

Indicator coupler 350 may secure indicator plate 360 to plunger 300 via plunger coupler 302. In one implementation, indicator coupler 350 may be screwed into plunger coupler 302, which may in turn be screwed into plunger 300. Indicator coupler 350 may be adjusted, for example, to control the start/stop height of indicator cam 330 and indicator plate 360.

Indicator plate 360 may translate motion from plunger 300 to indicator cam 330. In FIG. 3, indicator plate 360 (along with plunger 300 and indicator can 330) is shown in a maximum up (highest) position.

In operation, activation of plunger 300 in a downward stroke may cause a corresponding downward motion of indicator plate 360 and indicator cam 330. While traveling in an axial direction, plunger 300, indicator cam 330, and indicator plate 360 may not rotate. The downward motion of indicator cam 330 into recess 310 may force rotation (e.g., about 60 degrees of counter-clockwise rotation) of color display disc 320 by guiding pin 324 through the spiral channel of indicator can 330. The rotation of color display disc 320 may cause first color sections 410 to move behind the opaque sections of indicator lens 220 and cause second color sections 420 to become visible through the non-opaque sections of indicator lens 220. Activation of plunger 300 in an upward stroke may reverse the cycle, causing color display disc 320 to rotate back to its original orientation to display first color sections 410.

Figure 5:
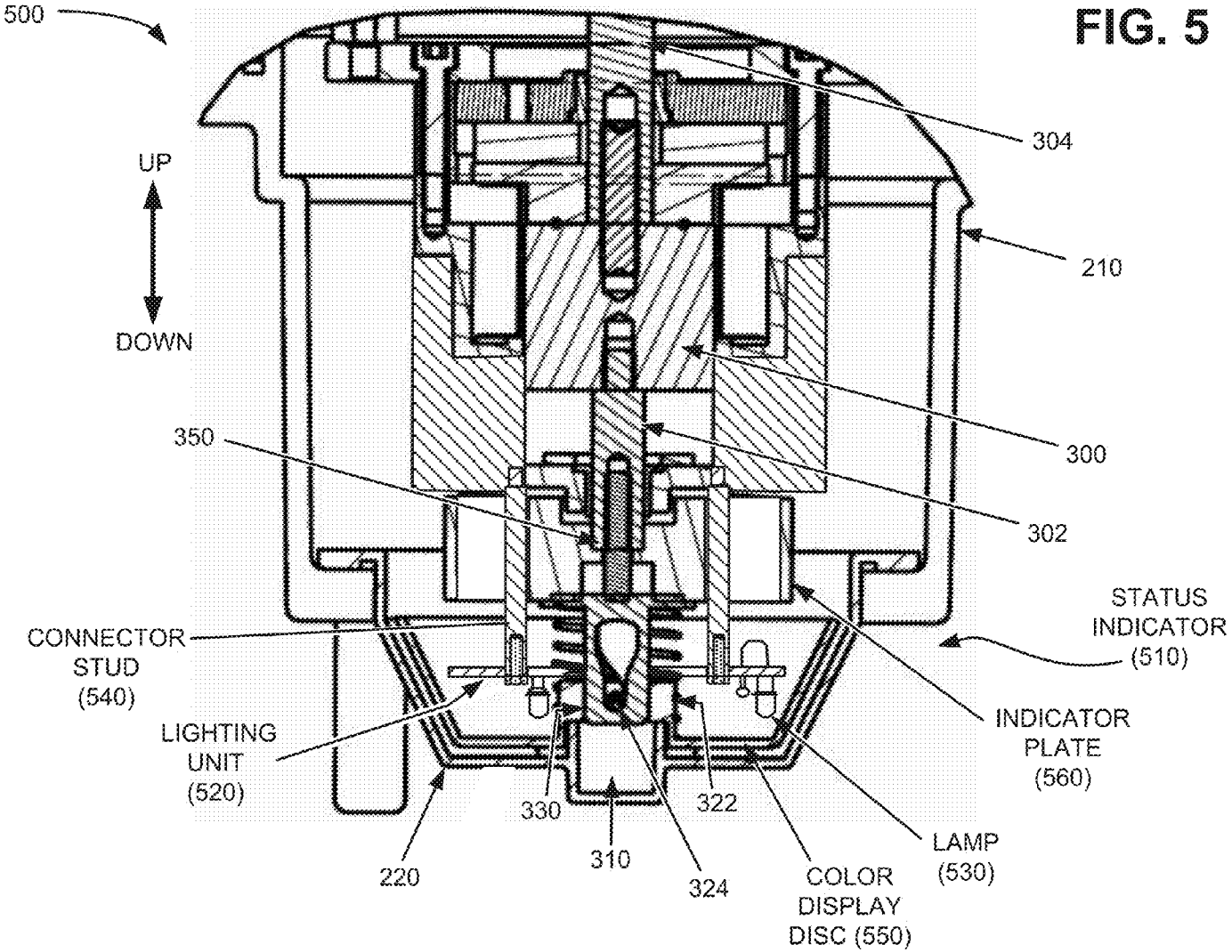
FIG. 5 is a cross-sectional view of an actuator according to another implementation described herein.

FIG. 5 is a cross-sectional view of an actuator 500 according to another implementation described herein. Referring to FIG. 5, actuator 500 may include housing 210, plunger 300, and a status indicator 510. Status indicator 510 may include indicator lens 220 with recess 310; indicator cam 330; spring 340; indicator coupler 350; a lighting unit 520 with lamps 530 and connector studs 540; a color display disc 550, and an indicator plate 560. The exemplary configuration illustrated in FIG. 5 is provided for simplicity. It should be understood that actuator 500 may include more or fewer devices than illustrated in FIG. 5.

Plunger 300, indicator lens 220 with recess 310, indicator cam 330, spring 340, and indicator coupler 350 may include features similar to those describe above in connection with FIGS. 2-4. Status indicator 510 generally may be configured to respond to changes in position of plunger 300. Components of status indicator 510 may be directly or indirectly connected to plunger 300 to provide status indications based on the position of plunger 300. In the configuration of FIG. 5, status indicator 510 may provide an illuminated status indication that can be visible at night.

Figure 6A:
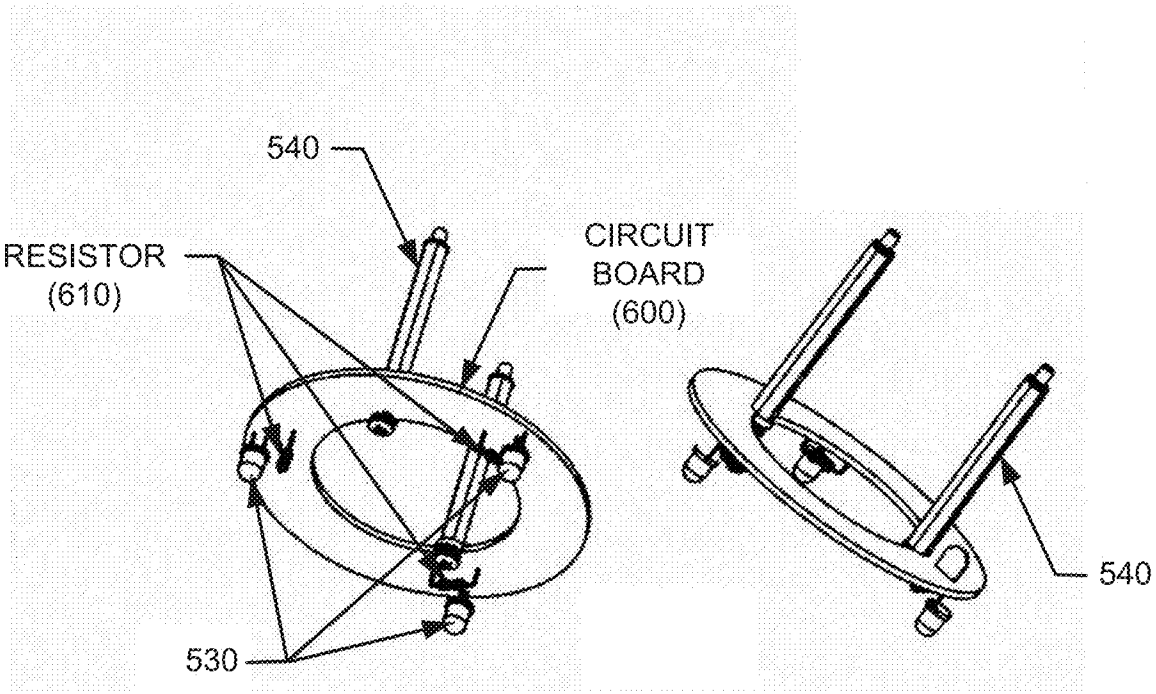
FIG. 6A provides isometric views of the lighting unit of FIG. 5 according to an implementation described herein.

Lighting unit 520 may be located within status indicator 510 (e.g., within the weather-proof enclosure formed by indicator lens 220. FIG. 6A provides isometric views of lighting unit 520. Referring collectively to FIGS. 5 and 6A, lighting unit 520 may include lamps 530, connector studs 540, circuit board 600, and resistors 610.

Lamps 530 may include, for example, one or more light emitting diode (LED) lamps, solid state lighting lamp, fluorescent lamp, plasma lamp, neon lamp, halogen lamp, multifilament lamp, gas discharge lamp, incandescent lamp, arc lamp, etc. Each of lamps 530 may be positioned over, for example, a different transparent section of indicator lens 220. In one implementation, each of lamps 530 may emit the same light color (e.g., white) that may be filtered by either color-coded sections 410 or color-coded sections 420 of color display disc 550 to provide a lighted indication. In other implementations, lamps 530 may include a multi-color light that may selectively illuminate a color corresponding to a status of recloser 100.

Connector studs 540 may include one or more structural pieces to secure circuit board 600 within status indicator. Connector studs 540 may be metal, plastic, or a composite material. In one implementation, connector studs 540 may be configured to extend through bores in indicator plate 560 to attach to a stationary component of actuator 500 within housing 210. Connector studs 540 may be sufficiently long to maintain circuit board 600 beyond the axial travel (or stroke) distance of indicator plate 560. One or more of connector studs 540 may also provide a conduit to provide electrical power to circuit board 600. For example, connector studs 540 may include an electrical contact to tie into a power supply (e.g., the same power supply used to activate actuator 500).

Circuit board 600 may include a printed circuit board to mechanically support and electrically connect lamps 530, connector studs 540, resistors 610, and other components. In one implementation, as shown in FIG. 6A, circuit board 600 may include a circular cutout to prevent interference with indicator cam 330 (and spring 340, not labeled in FIG. 5). In one implementation, circuit board 600 may be configured to continuously illuminate lamps 530. In another implementation, circuit board 600 may include or be operatively connected to a light sensor to only activate lamps 530 when low-light conditions are present.

Color display disc 550 may include a similar configuration to that of color display disc 320, including stem 322, pin 324, pin cavity 400, and color-coded sections 410/420. However, color display disc 550 may include a transparent or translucent material so that at least some bands of light emitted from LEDs 530 may be visible through color-coded sections 410/420. In one implementation, color-coded sections 410/420 may filter white light from LEDs 530 to provide a particular visible light color corresponding to each color-coded section 410/420.

Indicator plate 560 may include a similar configuration to that of indicator plate 360 with the exception that indicator plate 560 may include bores that allow connector studs 540 to pass through indicator plate 560 so that lighting unit 520 remains stationary when indicator plate 560 moves axially (e.g., when plunger 300 is actuated).

Figure 6B:
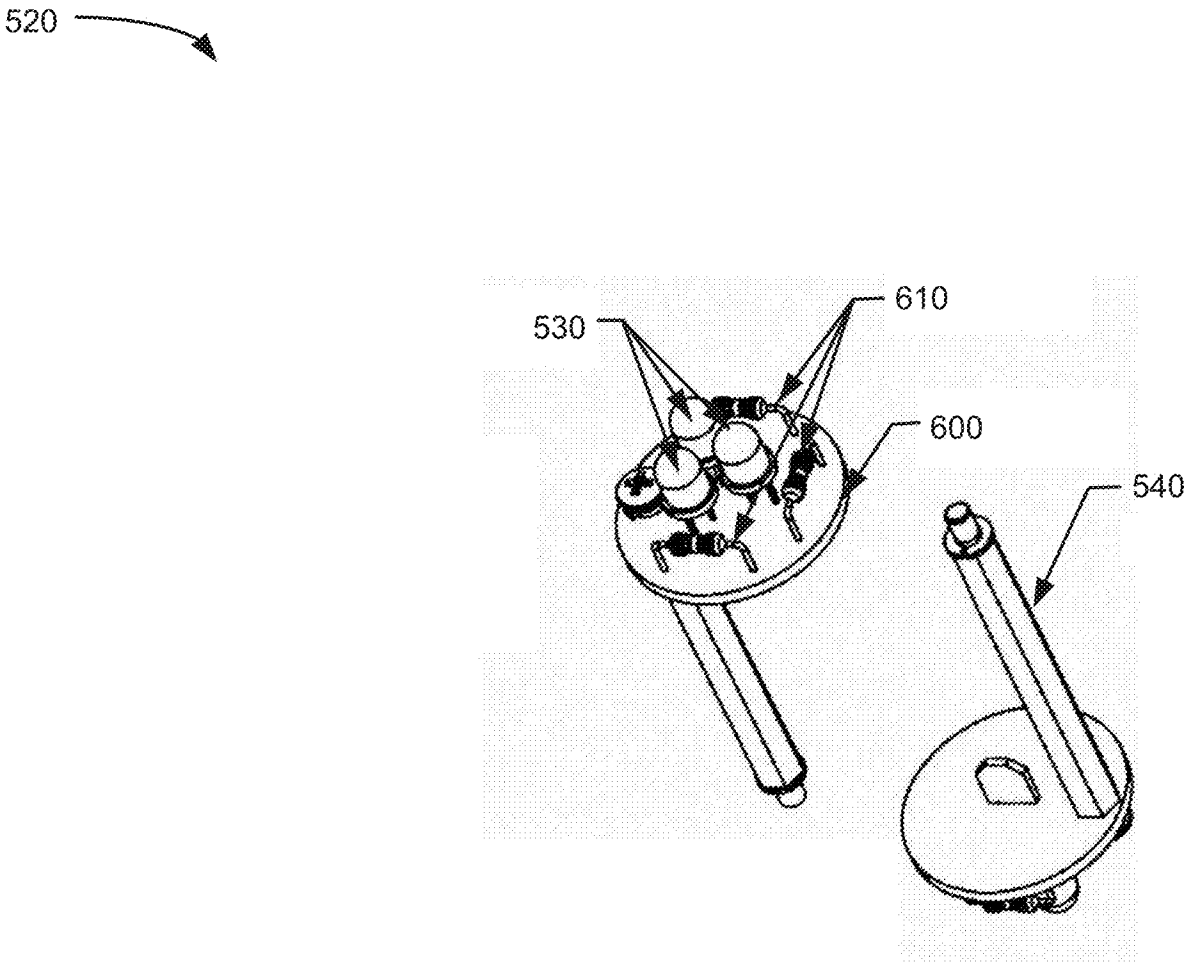
FIG. 6B provides isometric views of a lighting unit according to another implementation described herein.

In another implementation, as shown in FIG. 6B, circuit board 600 may be attached to a single connector stud 540. Lamps 530 and resistors 610 may be clustered in a small area and positioned over, for example, a single transparent section of indicator lens 220. In the configuration of FIG. 6B, each of lamps 530 may include a different color that may be selectively illuminated to indicate a different status/position of recloser 100. Thus, in the configuration of FIG. 6B, status indicator 510 would not need to rely on color-coded sections 410/420 to provide a color filter. Instead, the position of components of actuator 500 (e.g., plunger 300, plunger coupler 302, pull rod linker 304, etc.) could selectively trigger a different colored lamp 530.

Alternatively, in the configuration of FIG. 6B, each of lamps 530 may include a same color to provide additional intensity and/or redundancy. The cluster of lamps 530 could be filtered by a single one of color-coded sections 410/420. In still another implementation, a single lamp color may be used to indicate a status. The single lamp color may be illuminated to indicate one position (e.g., open) and not illuminated to indicate another position (e.g., closed).

Figure 7:
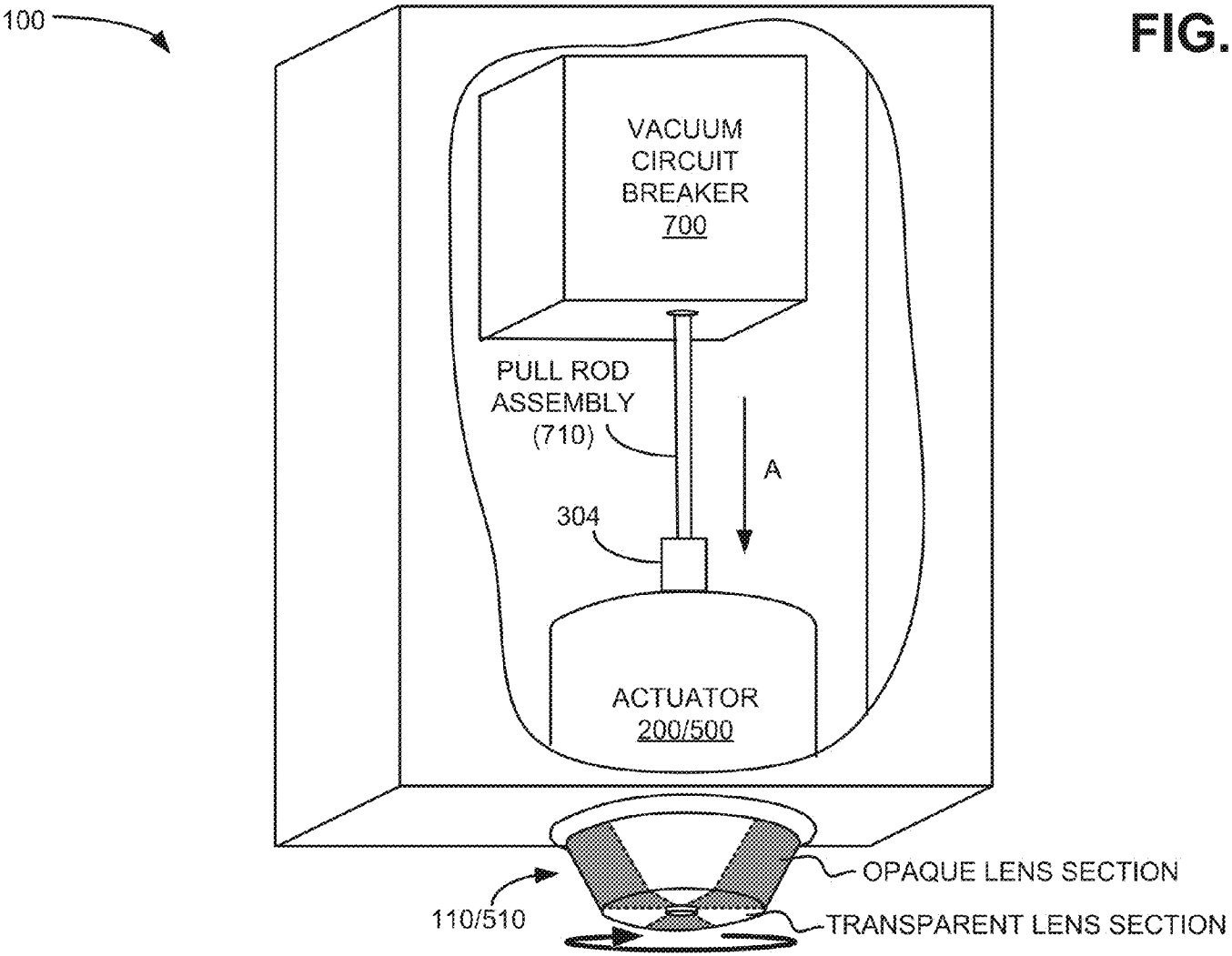
FIG. 7 is a block diagram illustrating use of the position indicator in a system including a circuit breaker.

Status indicator 110/510 may be used in a number of implementations in which conventional indicators may not be efficient due to, for example, lighting conditions and/or space conditions. FIG. 7 is a simplified diagram of an exemplary recloser 100 in which actuator 200 or 500 may be used. Referring to FIG. 7, recloser 100 includes actuator 200 or 500, vacuum circuit breaker 700 and pull rod assembly 710. Pull rod assembly 710 may include a cable or some other structure that couples pull rod linker 304 of actuator 200/500 to vacuum circuit breaker 700. Pull rod assembly 710 may be coupled to actuator 200/500 via a clamping mechanism, a threaded connection, a bolt-on connection or via some other mechanism. Pull rod assembly 710 may move in direction A illustrated in FIG. 7 in response to movement of pull rod link 304. The linear movement of pull rod assembly 710 may be used to open or close vacuum circuit breaker 700. For example, in one embodiment, the movement of pull rod linker 304 may move pull rod assembly 710 to open the contacts of vacuum circuit breaker 700. In such a case, status indicator 110/510 may display a green color via sections 410/420 and/or lamps 530. Alternatively, movement of pull rod assembly 710 may actuate a trip mechanism to open or close vacuum circuit breaker 700. In each case, actuator 200/500 may be used to trip vacuum circuit breaker 700 at the appropriate time based on the particular conditions/requirements associated with operating conditions of recloser 700.

In response to movement of pull rod linker 304 (translated via plunger 300, plunger coupler 302, and indicator cam 330), status indicator 110/510 may change a visible indication in the transparent lens sections (e.g., from first color section 410 to second color section 420). In daylight, second color section 420 may show through the bottom and sides of the transparent lens sections of status indicator 110/510 to allow detection, from directly beneath recloser 100 or from a distant viewing angle, that recloser 100 has tripped. At night or low-light conditions, one or more lights (e.g., lamps 530) may illuminate second color section 420 through the transparent lens sections of status indicator 510 to allow detection, from directly beneath or from a distant viewing angle.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

For example, in some implementations, status indicators 510 may not include color display disc 320. Further, other types of connection mechanisms may be used to couple components of status indicators 110/510 to each other.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A status indicator, comprising:

a display disc including a stem located in a central portion of the display disc and a pin secured within a portion of the stem, wherein the display disc includes a first colored section and a second colored section;

a lens unit with an opaque section and a non-opaque section to alternately reveal the first colored section or the second color section, wherein one of the first colored section or the second colored section is visible from any angle within a hemisphere below the status indicator, and wherein the lens unit is configured to physically support the display disc; and an indicator cam configured to receive a linear force initiated by an actuator component and to translate the linear force to a rotational force on the pin, wherein the rotational force on the pin causes the display disc to rotate from a first position that aligns the first colored section with the non-opaque section to a second position that aligns the second colored section with the non-opaque section.

2. The status indicator of claim 1, further comprising:

a lighting unit to illuminate the first colored section or the second colored section from within the status indicator.

3. The status indicator of claim 2, wherein the first colored section and the second colored section are translucent.

4. The status indicator of claim 2, wherein the lighting unit includes multiple lamps surrounding the stem.

5. The status indicator of claim 1, further comprising:

an indicator plate to receive the linear force from the actuator component and to translate the linear force to the indicator cam.

6. The status indicator of claim 5, further comprising:

a spring between the indicator plate and the display disc, where the spring provides a compressive force to the indicator plate and the display disc.

7. The status indicator of claim 1, wherein the indicator cam is configured to rotate the display disc at least sixty degrees radially.

8. The status indicator of claim 1, wherein the display disc includes multiple first colored sections and multiple second colored sections of approximately equal size in an alternating sequence.

9. The status indicator of claim 1, wherein the lens unit is further configured to provide a weatherproof seal from outside elements.

10. A recloser device, comprising:

an actuator to impart liner motion to a plunger within a bore of the actuator; and an indicator to identify a position of the plunger within the actuator, wherein the indicator comprises:

a lens unit, affixed to the actuator, to physically support a display disc and allow the display disc to rotate within the lens unit, the display disc including at least one colored section and a pin located in a central portion of the display disc, and an indicator cam configured to translate linear motion from the plunger to rotational motion of the pin so as to rotate the display disc between a first position and a section position, wherein one of the at least one colored section is visible from any angle within a hemisphere below the indicator.

11. The recloser device of claim 10, further comprising:

a casing, the casing including an opening to expose the indicator for viewing.

12. The recloser device of claim 10, wherein the lens unit includes an opaque section and a non-opaque section to alternately reveal a first colored section or a second colored section of the display disc.

13. The recloser device of claim 10, wherein the indicator further comprises:

a spring configured to press the display disc against the lens unit.

14. The recloser device of claim 10, wherein the lens unit includes a transparent lens and a separate layer of opaque sections.

15. The recloser device of claim 10, wherein the indicator further comprises:

a lighting unit to illuminate the at least one colored section.

16. The recloser device of claim 15, wherein the lens unit includes three opaque sections and three non-opaque sections of equal size in an alternating sequence.

17. The recloser device of claim 16, wherein the lighting unit includes one of:

a lamp aligned with each of the three non-opaque sections, or multiple lamps aligned with one of the three non-opaque sections.

18. A recloser system comprising:

a circuit breaker;

an actuator to alter the position of the circuit breaker; and a status indicator, the status indicator comprising:

a display disc including at least one first-colored section and at least one second-colored section to indicate a status of the recloser system, a lens unit, affixed to a portion of the actuator, to physically support the display disc and allow the display disc to rotate within the lens unit, wherein the lens unit includes at least one opaque section and at least one non-opaque section to alternately reveal only the first-colored section or only the second-colored section, an indicator cam configured to receive a linear force initiated by a component within the actuator, wherein the indicator cam is further configured to translate the linear force to a rotational force on the display disc to cause the display disc to rotate from a first position that aligns the at least one first-colored section with the at least one non-opaque section to a second position that aligns the at least one second-colored section with the at least one non-opaque section, and a lighting unit configured to illuminate the at least one non-opaque section from within the status indicator, wherein either the at least one first-colored section or the at least one second-colored section is visible from any angle within a viewing hemisphere below the status indicator.

19. The recloser system of claim 18, wherein the display disc includes a partially-conical wall to present the at least one first-colored section at least one second-colored section.

20. A status indicator, comprising:

a display disc including a stem located in a central portion of the display disc and a pin secured within a portion of the stem, wherein the display disc includes a first colored section and a second colored section;

a lens unit with an opaque section and a non-opaque section to alternately reveal the first colored section or the second color section, wherein one of the first colored section or the second colored section is visible from any angle within a hemisphere below the status indicator;

an indicator plate to receive a linear force initiated by an actuator component and to translate the linear force to the indicator cam; and the indicator cam configured to receive the linear force via the indicator plate and to translate the linear force to a rotational force on the pin, wherein the rotational force on the pin causes the display disc to rotate from a first position that aligns the first colored section with the non-opaque section to a second position that aligns the second colored section with the non-opaque section.

21. The status indicator of claim 20, further comprising:

a lighting unit to illuminate the first colored section or the second colored section from within the status indicator.

22. The status indicator of claim 20, further comprising:

a spring between the indicator plate and the display disc, where the spring provides a compressive force to the indicator plate and the display disc.

* * * * *